US009279097B1

(12) United States Patent
Fast

(10) Patent No.: US 9,279,097 B1
(45) Date of Patent: Mar. 8, 2016

(54) POLYMERS FOR INDUSTRIAL LAUNDRY DETERGENTS

(71) Applicant: Ecolab USA Inc., St. Paul, MN (US)

(72) Inventor: Jonathan P. Fast, St. Paul, MN (US)

(73) Assignee: Ecolab USA, Inc., St. Paul, MN (US)

( * ) Notice: Subject to any disclaimer, the term of this patent is extended or adjusted under 35 U.S.C. 154(b) by 0 days.

(21) Appl. No.: 14/459,420

(22) Filed: Aug. 14, 2014

(51) Int. Cl.

| | |
|---|---|
| ***C11D 1/00*** | (2006.01) |
| ***C11D 3/43*** | (2006.01) |
| ***B08B 3/04*** | (2006.01) |
| ***C11D 3/37*** | (2006.01) |

(52) U.S. Cl.
CPC ..... *C11D 3/3757* (2013.01); *C11D 3/3723* (2013.01); *C11D 3/3776* (2013.01)

(58) Field of Classification Search
CPC ..... C11D 1/00; C11D 3/3746; C11D 3/3757; C11D 3/43; B08B 3/04
See application file for complete search history.

(56) References Cited

U.S. PATENT DOCUMENTS

| | | | |
|---|---|---|---|
| 3,328,309 | A | 6/1967 | Grifo |
| 3,782,898 | A | 1/1974 | Mandell, Jr. |
| 3,922,230 | A | 11/1975 | Lamberti et al. |
| 3,993,830 | A | 11/1976 | Dickson et al. |
| 4,490,271 | A | 12/1984 | Spadini et al. |
| 4,664,848 | A | 5/1987 | Oh et al. |
| 4,678,596 | A | 7/1987 | Dupre et al. |
| 4,698,174 | A | 10/1987 | Denzinger et al. |
| 4,702,858 | A | 10/1987 | Denzinger et al. |
| 4,797,223 | A | 1/1989 | Amick et al. |
| 4,814,102 | A | 3/1989 | Baur et al. |
| 4,895,658 | A | 1/1990 | Amjad |
| 4,897,220 | A | 1/1990 | Trieselt et al. |
| 4,999,869 | A | 3/1991 | Holland et al. |
| 5,004,557 | A | 4/1991 | Nagarajan et al. |
| 5,055,540 | A | 10/1991 | Hughes et al. |
| 5,076,957 | A | 12/1991 | Diehl et al. |
| 5,126,069 | A | 6/1992 | Kud et al. |
| 5,292,828 | A | 3/1994 | Jenkins et al. |
| 5,409,629 | A | 4/1995 | Shulman et al. |
| 7,132,468 | B2 | 11/2006 | Tepe |
| 8,317,879 | B2 | 11/2012 | Sowle et al. |
| 2001/0014658 | A1 | 8/2001 | Smith et al. |
| 2008/0306218 | A1 | 12/2008 | Madle et al. |
| 2010/0170303 | A1 | 7/2010 | Gohl et al. |
| 2011/0230387 | A1 | 9/2011 | Leyrer et al. |
| 2012/0015861 | A1* | 1/2012 | Manna et al. ..... 510/361 |
| 2012/0066840 | A1 | 3/2012 | Man et al. |
| 2012/0071384 | A1 | 3/2012 | Christensen et al. |
| 2012/0165242 | A1 | 6/2012 | Ng et al. |
| 2013/0047345 | A1 | 2/2013 | Fast et al. |
| 2013/0111675 | A1 | 5/2013 | Soontravanich et al. |
| 2013/0247308 | A1 | 9/2013 | Duerrschmidt et al. |
| 2014/0041131 | A1 | 2/2014 | Man et al. |
| 2014/0100153 | A1 | 4/2014 | Martinez-Crowley et al. |

FOREIGN PATENT DOCUMENTS

| | | | |
|---|---|---|---|
| EP | 0213500 | A2 | 3/1987 |
| EP | 0324568 | B1 | 7/1989 |
| EP | 0368214 | A2 | 5/1990 |
| EP | 0421664 | B1 | 4/1991 |
| EP | 0444791 | A1 | 9/1991 |
| EP | 0245987 | B1 | 10/1991 |
| EP | 0459077 | A1 | 12/1991 |
| EP | 0523950 | B1 | 1/1993 |
| JP | 2009029847 | | 2/2009 |
| JP | 2009114347 | | 5/2009 |
| JP | 2009114351 | | 5/2009 |

OTHER PUBLICATIONS

ACUSIOL 845 Polymer Brochure, Dow Fabric & Surface Care, 12 pages. Sep. 2011.

* cited by examiner

*Primary Examiner* — Brian P Mruk
(74) *Attorney, Agent, or Firm* — McKee, Voorhees & Sease, PLC

(57) ABSTRACT

The invention discloses detergent compositions containing acrylic acid polymers, including methacrylic acid/ethyl acrylate polymers. In certain embodiments compositions employ an acrylic acid polymer comprising at least 40 wt-% polymerized residues of acrylic monomers, at least 50 wt-% of at least one surfactant, a solvent, at least one water conditioning polymer, and water. The detergent compositions provide increased soil removal and soil suspension when treating textiles, namely through use of industrial laundering machinery. The detergent compositions and methods of employing the same beneficially clean and prevent redeposition of soils containing high concentrations of oil and metal particulates, as are customary in industrial laundering soils.

20 Claims, No Drawings

POLYMERS FOR INDUSTRIAL LAUNDRY DETERGENTS

FIELD OF THE INVENTION

The invention relates to detergent compositions utilized as laundry detergents, particularly industrial laundering where high oil and metal content soils are present. The detergent compositions employing acrylic acid polymers, including methacrylic acid/ethyl acrylate polymers are useful for increasing soil removal and soil suspension to prevent soil redeposition on textiles and within industrial laundering machinery. The detergent compositions and methods of employing the same are particularly suitable for industrial laundering as a result of the beneficial oil and metal suspension in the presence of industrial laundering soils having high oil and metal content.

BACKGROUND OF THE INVENTION

Surfactants and polymers are utilized in many laundry detergents to manage water conditions such as hardness and the presence of metals, along with increasing soil removal and soil suspension or anti-redeposition. These capabilities of laundry detergents are critical for industrial laundry, which relative to all other laundry classifications contain soil compositions having a high percentage of both oil and metals. Therefore, conventional laundry detergents are unable to provide efficacious laundering providing both oil suspension capabilities and ability to handle metals in the presence of such oil.

Insufficient oil suspension is particularly detrimental in industrial laundering. Washing equipment and machinery, namely shaker screens, can become coated in free soil when there is insufficient emulsification or soil suspension provided by a laundry detergent. Moreover, soils that are not appropriately suspended will re-deposit onto fabrics being laundered, resulting in buildup over repeated cycles and causing a graying or yellowing of the fabrics.

Various polymers, including polymers made from acrylic acid monomers are known for use in formulating laundry detergents. For example, U.S. Publication No. 2008/0306218 discloses polymerized residues of methacrylic acid, ethyl acrylate, a C12-polyethylene glycol ester of methacrylic acid and lauryl methacrylate. Moreover, U.S. Publication Nos. 2012/0165242 and 2012/0015861 disclose detergent compositions with less than 50 wt-% surfactants and polymerized residues of an acrylic acid terpolymer. However, such exemplary laundry detergents do not disclose high surfactant detergent composition in combination with acrylic acid polymers providing efficacious industrial laundering. Accordingly there is a continuing need to develop effective polymer and detergent systems that can be used to provide improve cleaning of industrial laundry soil compositions.

Accordingly, it is an objective of the claimed invention to develop industrial laundering detergents efficacious for soil removal and soil suspension while controlling metals present in the soils.

A further object of the invention is to provide methods for removing soils and suspending soils within an industrial laundering application without resulting in any yellowing or greying of soils due to the presence of metals in soils.

A further object of the invention is to provide compositions and methods of use thereof employing acrylic acid polymers, including methacrylic acid/ethyl acrylate polymers for industrial laundering.

Other objects, advantages and features of the present invention will become apparent from the following specification taken in conjunction with the accompanying drawings.

SUMMARY OF THE INVENTION

An advantage of the invention providing compositions and methods for industrial laundering is to provide soil removal and anti-deposition while controlling metals. It is a particular advantage of the present invention that the high percentage of both oil and metals in industrial laundering soil compositions are efficaciously cleaned.

In an embodiment, the present invention discloses methods for removing soils from a soft surface and preventing redeposition thereon comprising: applying a detergent composition to a soft surface in need of cleaning within a washing machine, wherein the detergent composition comprises an acrylic acid polymer, surfactants, solvent, and a water conditioning polymer, wherein the acrylic acid polymer has at least 40 wt-% polymerized residues of acrylic monomers, and wherein the surfactants comprise at least 50 wt-% of the detergent composition; washing the soft surface; and rinsing and/or wiping the detergent composition from the soft surface.

In a further embodiment, the present methods for removing soils from a soft surface and preventing redeposition thereon comprising: applying a detergent composition to a soft surface in need of cleaning and containing soils having at least about 50% oil content and further containing metal ions, wherein the detergent composition comprises an acrylic acid polymer, surfactants, solvent, and a water conditioning polymer, wherein the acrylic acid polymer has at least 40 wt-% polymerized residues of acrylic monomers, and wherein the surfactants comprise at least 50 wt-% of the detergent composition; washing the soft surface employing the detergent composition at a dosing rate between about 1-30 oz/cwt; and rinsing and/or wiping the detergent composition from the soft surface.

In a still further embodiment, the present invention discloses industrial laundering compositions comprising: an acrylic acid polymer comprising at least 40 wt-% polymerized residues of acrylic monomers; at least 50 wt-% of at least one surfactant; a solvent; at least one water conditioning polymer; and water, wherein the composition removes and prevents redeposition of high oil and metal content soils present in industrial laundering applications.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE INVENTION

So that the invention may be more readily understood, certain terms are first defined and certain test methods are described herein. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The embodiments of this invention are not limited to the particular embodiments illustrated as exemplary industrial laundry detergents, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

The reference to "cleaning" refers to at least one of the removal of soil, the removal of staining or the appearance of staining, and/or the reduction of a population of microbes. A cleaning process can include all three of the removal of soil, the removal of staining or the appearance of staining, and the reduction of a population of microbes. In other embodiments, a cleaning process can include any one of the removal of soil, the removal of staining or the appearance of staining, or the reduction of a population of microbes. In yet other embodiments, a cleaning process can include any combination of the removal of soil, the removal of staining or the appearance of staining, and the reduction of a population of microbes.

As used herein, the term "cleaning composition" includes, unless otherwise indicated, detergent compositions, including industrial laundry cleaning compositions, hard surface cleaning compositions, compositions for industrial services, such as energy service applications and the like. Cleaning compositions may include granular, powder, liquid, gel, paste, bar form and/or flake type cleaning agents, laundry detergent cleaning agents, laundry soak or spray treatments, fabric treatment compositions, and other similar cleaning compositions.

The term "hard surface" refers to a solid, substantially non-flexible surface such as a counter top, tile, floor, wall, panel, window, plumbing fixture, kitchen and bathroom furniture, appliance, engine, circuit board, and dish. The term "soft surface" refers to a softer, highly flexible material such as fabric, carpet, hair, and skin.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardency. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

As used herein, the term "microemulsion" refers to thermodynamically stable, isotropic dispersions consisting of nanometer size domains of water and/or oil stabilized by an interfacial film of surface active agent characterized by ultra-low interfacial tension.

As used herein, the term "polymer" generally includes, but is not limited to, homopolymers, copolymers, such as for example, block, graft, random and alternating copolymers, terpolymers, and higher "x"mers, further including their derivatives, combinations, and blends thereof. Furthermore, unless otherwise specifically limited, the term "polymer" shall include all possible isomeric configurations of the molecule, including, but are not limited to isotactic, syndiotactic and random symmetries, and combinations thereof. Furthermore, unless otherwise specifically limited, the term "polymer" shall include all possible geometrical configurations of the molecule.

"Soil" or "stain" refers to a non-polar oily substance which may or may not contain particulate matter such as mineral clays, sand, natural mineral matter, carbon black, graphite, kaolin, environmental dust, etc. As referred to herein, industrial laundry soils or stains have particularly high percentages of both oily substances and metals.

Weight percent, percent by weight, % by weight, wt %, and the like are synonyms that refer to the concentration of a substance as the weight of that substance divided by the weight of the composition and multiplied by 100.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

EMBODIMENTS

Exemplary ranges of the industrial laundry detergent compositions according to the invention are shown in Table 1 in weight percentage of the liquid concentrate detergent compositions.

TABLE 1

| Material | First Exemplary Range wt-% | Second Exemplary Range wt-% | Third Exemplary Range wt-% | Fourth Exemplary Range wt-% |
|---|---|---|---|---|
| Acrylic Acid Polymer | 0.1-15 | 0.1-10 | 1-10 | 1-5 |
| Surfactants | 10-99 | 20-90 | 50-90 | 50-80 |
| Water Conditioning Polymers | 0.1-15 | 1-10 | 1-5 | 2-5 |
| Stabilizing Agents (e.g. solvents) | 1-50 | 5-50 | 10-50 | 10-30 |
| Water | 1-50 | 5-50 | 10-50 | 15-25 |
| Additional Functional Ingredients | 0-25 | 0-20 | 0-10 | 0-5 |

The concentrate detergent compositions according to the invention may be diluted to form use compositions. In general, a concentrate refers to a composition that is intended to be diluted with water to provide a use solution that contacts an object to provide the desired cleaning, or the like. The detergent composition contacting the articles to be washed can be referred to as a concentrate or a use composition (or use solution) dependent upon the formulation employed in methods according to the invention. It should be understood that the concentration of the acrylic acid polymer, surfactants, water conditioning polymers, stabilizing agents, water and other optional additional functional ingredients in the detergent composition will vary depending on the concentrate and/or use solution provided.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:3,000 concentrate to water.

The detergent composition set forth above as concentrated liquid detergents may also be formulated into alternative compositions, such as for example, paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a molded casing (such as an injection molded casing) etc. Preferably the composition is substantially surrounded by such a package, most preferably totally surrounded by such a package. Any such package may contain one or more product formats as referred to herein and the package may contain one or more compartments as desired, for example two, three or four compartments. If the composition is a foam, a liquid or a gel it is preferably an aqueous composition although any suitable solvent may be used. If the compositions are in the form of a viscous liquid or gel they preferably have a viscosity of at least 50 mPas when measured with a Brookfield RV Viscometer at 25° C. with Spindle 1 at 30 rpm.

Acrylic Acid Polymer

The detergent compositions according to the invention include an acrylic acid polymer. As referred to herein, the acrylic acid polymer refers to a copolymer and/or terpolymer as disclosed herein. In addition, as used herein the term acrylic refers to acrylic and/or methacrylic. In an aspect, the compositions include from about 0.1 wt-%-15 wt-% acrylic acid polymer, from about 1 wt-%-10 wt-% acrylic acid polymer, from about 1 wt-%-10 wt-% acrylic acid polymer, preferably from about 1 wt-%-5 wt-% acrylic acid polymer. In addition, without being limited according to the invention, all ranges recited are inclusive of the numbers defining the range, including for example each integer within the defined range.

The acrylic acid polymer has at least 50 wt-% polymerized residues of acrylic monomers, preferably at least 60 wt-%, preferably at least 70 wt-%, preferably at least 80 wt-%, preferably at least 90 wt-%, or preferably at least 95 wt-%. Acrylic monomers include acrylic acids, methacrylic acids and their $C_1$-$C_{25}$ alkyl or hydroxyalkyl esters, including for example monomers of structure $H_2C{=}C(R)CRCO_2(CH_2CH_2O)_n(CH(R')CH_2O)_m{-}R''$; crotonic acid, itaconic acid, fumaric acid, maleic acid, maleic anhydride, (meth) acrylamides, (meth)acrylonitrile and alkyl or hydroxyalkyl esters of crotonic acid, itaconic acid, fumaric acid or maleic acid.

The acrylic acid polymer is provided in an aqueous composition with the polymer as discrete particles dispersed therein. The acrylic polymer comprising other polymerized monomer residues, may include for example, non-ionic (meth)acrylate esters, cationic monomers, $H_2C{=}C(R)C_6H_4C(CH_3)_2NHCO_2(CH_2CH_2O)_n(CH(R')CH_2O)_mR''$, $H_2C{=}C(R)C(O)X(CH_2CH_2O)_n(CH(R')CH_2O)_mR''{-}$, monounsaturated dicarboxylates, vinyl esters, vinyl amides (e.g. N-vinylpyrrolidone), sulfonated acrylic monomers, vinyl sulfonic acid, vinyl halides, phosphorus-containing monomers, heterocyclic monomers, styrene and substituted styrenes. In a preferred aspect, the polymer contains no more than 5 wt-% sulfur- or phosphorus-containing monomers, preferably no more than 3 wt-%, preferably no more than 2 wt-%, preferably no more than 1 wt-%.

The acrylic acid polymer may comprise, consist of and/or consist essentially of polymerized residues of:

(i) C1-C18 alkyl (meth)acrylates;

(ii) C3-C6 carboxylic acid monomers, wherein the monomer is a mono-ethylenically unsaturated compound having one or two carboxylic acid groups. For example, the monomer may include acrylic acid, methacrylic acid, maleic acid, fumaric acid, itaconic acid, maleic anhydride, crotonic acid, etc.; and (iii) monomers having the following structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$; wherein X is O or NH, R is H or $CH_3$, R' is $C_1$-$C_2$ alkyl; R" is $C_8$-$C_{25}$ alkyl, $C_8$-$C_{16}$ alkylphenyl or $C_{13}$-$C_{36}$ aralkylphenyl; n is an average number from 6-100 and m is an average number from 0-50, provided that n≥m and m+n is 6-100.

As referred to herein, alkyl groups are saturated hydrocarbyl groups which may be straight or branched. Aralkyl groups are alkyl groups substituted by aryl groups. Examples of aralkyl groups include, for example, benzyl, 2-phenylethyl and 1-phenylethyl. Aralkylphenyl groups are phenyl groups having one or more aralkyl substituents.

In an aspect, the polymer has a weight average molecular weight of at least 25,000, at least 50,000, at least 100,000, at least 150,000, preferably at least 180,000, preferably at least 200,000, preferably at least 300,000. In some cases, including cross-linked polymers, the MW can be as high as Ser. No.

10/000,000. In preferred aspects, the MW is less than 5,000,000, less than 2,000,000, and more preferably less than 1,000,000.

Cross-linked polymers, such as a monomer having two or more non-conjugated ethylenically unsaturated groups, included with the copolymer components during polymerization. Examples of such monomers include, di- or tri-allyl ethers and di- or tri-(meth)acrylyl esters of diols or polyols (e.g., trimethylolpropane diallyl ether (TMPDE), ethylene glycol dimethacrylate), di- or tri-allyl esters of di- or tri-acids, allyl (meth)acrylate, divinyl sulfone, triallyl phosphate, divinylaromatics (e.g., divinylbenzene). In a preferred aspect, the amount of polymerized crosslinker residue in the polymer is less than 0.3 wt-%, less than 0.2 wt-%, less than 0.1 wt-%, less than 0.05 wt-%, or less than 0.01 wt %.

In a preferred aspect, polymerized residues may include from 40 to 65 wt-% C1-C18 alkyl (meth)acrylates; from 25 to 55 wt-% C3-C6 carboxylic acid monomers; and from 0 to 20 wt-% of monomers having the following structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$; wherein X is O or NH, R is H or $CH_3$, R' is $C_1$-$C_2$ alkyl; R'' is $C_8$-$C_{25}$ alkyl, $C_8$-$C_{16}$ alkylphenyl or $C_{13}$-$C_{36}$ aralkylphenyl; n is an average number from 6-100 and m is an average number from 0-50, provided that n≥m and m+n is 6-100.

A commercially-available acrylic acid polymer is a methacrylic acid/ethyl acrylate polymer (Acusol 845, Dow Chemical) which beneficially suspends both oils and metals according to the formulated compositions according to the invention for industrial laundering. Additional disclosure of suitable embodiments of the acrylic acid polymer is set forth in U.S. Publication Nos. 2012/0165242 and 2012/0015861, which are herein incorporated by reference in their entirety.

Surfactants

The industrial laundry detergent compositions of the present invention include a surfactant. Surfactants suitable for use with the compositions of the present invention include, but are not limited to nonionic surfactants anionic surfactants, and amphoteric surfactants, such as amine oxides. In an aspect, the compositions include from about 10 wt-%-99 wt-% surfactants, from about 20 wt-%-90 wt-% surfactants, from about 40 wt-%-80 wt-% surfactants, from about 50 wt-%-90 wt-% surfactants, preferably from about 50 wt-%-80 wt-% surfactants. In a preferred aspect, the compositions include greater than 50 wt-% surfactants. In addition, without being limited according to the invention, all ranges recited are inclusive of the numbers defining the range, including for example each integer within the defined range.

Nonionic Surfactants

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp. Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. 3.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. 4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. These reverse Pluronics™ are manufactured by BASF Corporation under the trade name Pluronic™ R surfactants. Likewise, the Tetronic™ R surfactants are produced by BASF Corporation by the sequential addition of ethylene oxide and propylene oxide to ethylenediamine. The hydrophobic portion of the molecule weighs from about 2,100 to about 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

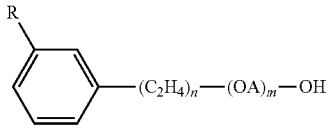

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n\ (C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R_2CON_{R1}Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from about 0 to about 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_6$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use the present compositions include those having the formula: $R_6CON(R_7)_2$ in which $R_6$ is an alkyl group containing from 7 to 21 carbon atoms and each $R_7$ is independently hydrogen, $C_1$-$C_4$ alkyl, $C_1$-$C_4$ hydroxyalkyl, or —$(C_2H_4O)_xH$, where x is in the range of from 1 to 3.

13. A useful class of non-ionic surfactants include the class defined as alkoxylated amines or, most particularly, alcohol alkoxylated/aminated/alkoxylated surfactants. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—$N[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. Preferred nonionic surfactants for the compositions of the invention include alcohol alkoxylates, EO/PO block copolymers, alkylphenol alkoxylates, and the like.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

14. Amine oxides are tertiary amine oxides corresponding to the general formula:

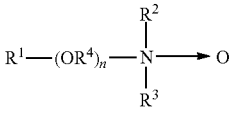

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl) amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

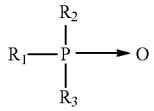

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

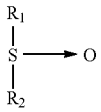

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. As those skilled in the art understand, anionics are excellent detersive surfactants and are therefore favored additions to heavy duty detergent compositions.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R is a $C_8$ to $C_{22}$ alkyl group or

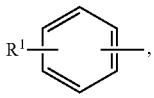

in which $R^1$ is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R is a $C_8$-$C_{16}$ alkyl group. In some embodiments, R is a $C_{12}$-$C_{14}$ alkyl group, n is 4, and m is 1.

In other embodiments, R is

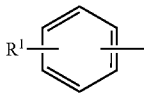

and $R^1$ is a $C_6$-$C_{12}$ alkyl group. In still yet other embodiments, $R^1$ is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

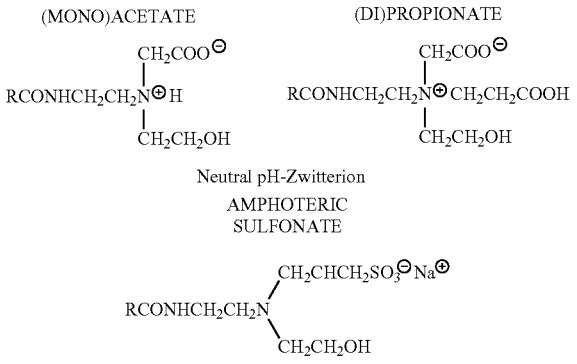

wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R=$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—$N^+(CH_2—CH_2—CO_2Na)_2$—$CH_2$—$CH_2$—OH or $C_{12}$-alkyl-C(O)—N(H)—$CH_2$—$CH_2$—$N^+(CH_2—CO_2Na)_2$—$CH_2$—$CH_2$—OH. Disodium cocoampho dipropionate and disodium cocoampho diacetate are commercially-available examples.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references are herein incorporated by reference in their entirety.

Water Conditioning Polymers

The industrial laundry detergent compositions of the present invention include at least one water conditioning polymer. One or more water conditioning agents may be employed in the laundry detergents according to the invention.

In an aspect, the water conditioning polymer is a polyacrylate, polycarboxylate or polycarboxylic acid. Exemplary polycarboxylates that can be used as builders and/or water conditioning polymers include, but are not limited to: those having pendant carboxylate (—$CO_2^-$) groups such as acrylic homopolymers, polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of water conditioning polymers, see Kirk-Othmer, Encyclopedia of Chemical Technology, Third Edition, volume 5, pages 339-366 and volume 23, pages 319-320, the disclosure of which is incorporated by reference herein. According to an embodiment of the invention, the water conditioning polymer may be a non-phosphorus polymer. In a further embodiment, a neutralized polycarboxylic acid polymer may be employed as the water conditioning polymer.

In an aspect, the water conditioning polymer is an aminocarboxylic acid and/or salt, also referred to herein as an aminocarboxylate. Beneficially, aminocarboxylates may include aminocarboxylic acids and/or salts of the aminocarboxylic acids. Such materials used according to the invention do not contain phosphorus and/or contain little to no nitrilotriacetic acid (NTA) and are biodegradable. In one embodiment, the aminocarboxylate used in the low alkaline detergent composition has the following structure:

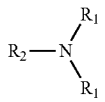

wherein $R_1$ is selected from any one of H, $CH_3$, $CH_2COOH$, $CH(COOH)CH_2COOH$, $CH(CH_3)COOH$, $CH(COOH)CH_2CH_2COOH$, $CH_2CH(OH)CH_3$, $CH_2COOH$, $CH_2CH_2COOH$, and $CH_2OH$; and wherein $R_2$ is selected from any one of H, COOH, $CH_2COOH$, $CH_2OH$, $CH_2CH_2OH$, $CH_2CH_2CH_2OH$, $CH_2CH(OH)CH_3$, $CH_2CH_2N(CH_2COOH)_2$, $CH_2CH_2NHCH_2CH_2N(CH_2COOH)_2$, $CH_2CH_2NHCH(COOH)CH_2COOH$, $CH(CH_3)COOH$, $CH(COOH)CH_2CH_2COOH$, $CH(COOH)CH_2OH$, and $CH(COOH)CH_2CH_2OH$.

Useful aminocarboxylic acids according to the invention include, but are not limited to: methylglycinediacetic acid (MGDA), glutamic acid-N,N-diacetic acid (GLDA), N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. Additional description of suitable aminocarboxylates suitable for use as chelating agents is set forth in Kirk-Othmer, Encyclopedia of Chemical Technology, Third Edition, volume 5, pages 339-366 and volume 23, pages 319-320, the disclosure of which is incorporated by reference herein.

In an embodiment, MGDA or its acid salts and/or derivatives are employed as the aminocarboxylic acid water conditioning agent. MGDA trisodium salt is commercially-available as a 40% solution of the trisodium salt under the tradename Trilon M® (BASF Corporation). MGDA has the general structure shown below:

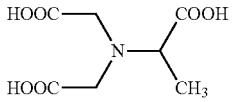

In additional embodiments of the invention, the structure of MGDA may have a number of acidic protons replaced to neutralize or partially neutralize the structure. For example, 1, 2 or 3 of the acid groups may be neutralized or partially neutralized. In addition, the aminocarboxylate (e.g. MGDA) may be present as either enantiomer or a racemic mixture thereof.

In an aspect, the compositions include from about 0.1 wt-%-15 wt-% water conditioning polymer, from about 1 wt-%-10 wt-% water conditioning polymer, from about 1 wt-%-5 wt-% water conditioning polymer, preferably from about 2 wt-%-5 wt-% water conditioning polymer. In addition, without being limited according to the invention, all ranges recited are inclusive of the numbers defining the range, including for example each integer within the defined range.

In a further aspect, the compositions according to the invention include a combination of the acrylic acid polymer and water conditioning polymers in the amount of from about 1-10 wt-% of the detergent composition, from about 2-10 wt-% of the detergent composition, from about 4-7.5 wt-% of the detergent composition, and more preferably about 5 wt-% of the detergent composition.

Solvents/Carriers/Stabilizing Agents

The industrial laundry detergent compositions of the present invention include at least one stabilizing agent, carrier and/or solvent. Suitable solvents for the detergent compositions include water and other solvents such as lipophilic fluids. Examples of suitable lipophilic fluids include glycol ethers, glycerine derivatives such as glycerine ethers, perfluorinated amines, perfluorinated and hydrofluoroether solvents, low-volatility nonfluorinated organic solvents, diol solvents, siloxanes, other silicones, hydrocarbons, other environmentally-friendly solvents and mixtures thereof. In some embodiments, the solvent includes water, propylene glycol, and/or dipropylene glycol methyl ether.

In other aspects, examples of suitable carriers include, but are not limited to: organic solvents, such as simple alkyl alcohols, e.g., ethanol, isopropanol, n-propanol, benzyl alcohol, and the like. Polyols are also useful carriers, including glycerol, sorbitol, and the like. Suitable carriers include glycol ethers. Suitable glycol ethers include diethylene glycol n-butyl ether, diethylene glycol n-propyl ether, diethylene glycol ethyl ether, diethylene glycol methyl ether, diethylene glycol t-butyl ether, dipropylene glycol n-butyl ether, dipropylene glycol methyl ether, dipropylene glycol ethyl ether, dipropylene glycol propyl ether, dipropylene glycol tert-butyl ether, ethylene glycol butyl ether, ethylene glycol propyl ether, ethylene glycol ethyl ether, ethylene glycol methyl ether, ethylene glycol methyl ether acetate, propylene glycol n-butyl ether, propylene glycol ethyl ether, propylene glycol methyl ether, propylene glycol n-propyl ether, tripropylene glycol methyl ether and tripropylene glycol n-butyl ether, ethylene glycol phenyl ether, propylene glycol phenyl ether, and the like, or mixtures thereof.

In other aspects, examples of suitable stabilizing agents include, but are not limited to: borate, calcium/magnesium ions, and mixtures thereof. The concentrate need not include a stabilizing agent, but when the concentrate includes a stabilizing agent, it can be included in an amount that provides the desired level of stability of the concentrate. In an aspect, the compositions include from about 1 wt-%-50 wt-% solvents and/or stabilizing agents, from about 5 wt-%-50 wt-% solvents and/or stabilizing agents, from about 10 wt-%-50 wt-% solvents and/or stabilizing agents, and preferably from about 10 wt-%-30 wt-% solvents and/or stabilizing agents. In addition, without being limited according to the invention, all ranges recited are inclusive of the numbers defining the range, including for example each integer within the defined range.

Additional Functional Ingredients

The components of the detergent composition can further be combined with various functional components suitable for use in laundering applications. In some embodiments, the detergent composition including the acrylic acid polymers, water, stabilizing agents (chelants) and water conditioning polymers make up a large amount, or even substantially all of the total weight of the detergent composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used Additional functional ingredients may include defoaming agents, bleaching agents or optical brighteners, solubility modifiers, buffering agents, dye transfer inhibiting agents, dispersants, stabilizing agents, sequestrants and/or chelating agents to coordinate metal ions and control water hardness, fragrances and/or dyes, rheology modifiers or thickeners, hydrotropes or couplers, buffers, solvents and the like.

In an aspect, the compositions include from about 0 wt-%-25 wt-% additional functional ingredients, from about 0 wt-%-20 wt-% additional functional ingredients, from about 0 wt-%-10 wt-% additional functional ingredients, or from about 0 wt-%-5 wt-% additional functional ingredients. In addition, without being limited according to the invention, all ranges recited are inclusive of the numbers defining the range, including for example each integer within the defined range.

Optical Brightener

In some embodiments, an optical brightener component may be present in the compositions of the present invention. The optical brightener can include any brightener that is capable of lessening graying and yellowing of fabrics. Typically, these substances attach to the fibers and bring about a brightening action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal CBS-X, which is commercially available through BASF Corp.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include lower levels of from about 0.01, from about 0.05, from about 0.1 or even from about 0.2 wt. % to upper levels of 0.5 or even 0.75 wt. %.

Dye Transfer Inhibiting Agents

The laundry detergent may also include of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Buffering Agents

The laundry detergent may also include a buffer and/or a pH-adjusting agent, including inorganic and/or organic alkalinity sources and acidifying agents such as water-soluble alkali metal, and/or alkali earth metal salts of hydroxides, oxides, carbonates, bicarbonates, borates, silicates, phosphates, and/or metasilicates; or sodium hydroxide, potassium hydroxide, pyrophosphate, orthophosphate, polyphosphate, and/or phosphonate. The organic alkalinity source herein includes a primary, secondary, and/or tertiary amine. The inorganic acidifying agent herein includes HF, HCl, HBr, HI, boric acid, sulfuric acid, phosphoric acid, and/or sulphonic acid; or boric acid. The organic acidifying agent herein includes substituted and substituted, branched, linear and/or cyclic C1-30 carboxylic acids.

Methods of Making Detergent Compositions

The compositions of the invention may be made by any suitable method depending upon their format. Suitable manufacturing methods for detergent compositions are well known in the art, non-limiting examples of which are described in U.S. Pat. Nos. 5,879,584, 5,691,297, 5,574,005, 5,569,645, 5,565,422, 5,516,448, 5,489,392 and 5,486,303.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. Agitation of the mixture is continued, and if necessary, can be increased at this point to form a solution or a uniform dispersion of insoluble solid phase particulates within the liquid phase. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

Methods of Use

The detergent compositions according to the invention are primarily suited for use in industrial laundering applications. In an aspect, industrial laundering soils have an increase in soil loading (approximately 2 g/L) in comparison to consumer laundry (approximately 0.5-0.6 g/L), and further have an increased oil content, often with mineral oils and greases along with the presence of free metals (Textile Rental Services Association of America, Charles L. Riggs, Textile Laundering Technology 2005; 70). In an aspect, industrial laundry processes are particularly suitable for textile materials such as pants, shirts, coveralls, shop towels, and the like. However, the compositions may have many uses and applications which include but are not limited to: laundry cleaning, hard surface cleaning, all-purpose cleaning, metal handling in the presence of soils, including industrial and energy services applications, etc.

The compositions of the invention will typically be used by placing them in a detergent dispenser in an automatic industrial laundering machine. However, if the composition is in the form of a foam, liquid or gel then it may be applied to by any additional suitable means into the laundering machine, for example by a trigger spray, squeeze bottle or an aerosol.

In an aspect, the methods including adding water to dry linen load for washing according to the methods herein. In an aspect, water is added to dry linen at a ratio of from about 1:1 to about 10:1 water to linen/laundry, from about 2:1 to 7.5:1, or from about 2:1 to 5:1.

In an aspect, the methods including generating a use solution of a concentrate detergent composition. Dilution ratios can be between about 1:10 and about 1:10,000 to form a use solution. In an embodiment, the concentrate is diluted at a ratio of between about 1:10 and about 1:10,000 concentrate to water. Particularly, the concentrate is diluted at a ratio of between about 1:100 and about 1:5,000 concentrate to water. More particularly, the concentrate is diluted at a ratio of between about 1:250 and about 1:3,000 concentrate to water.

In an aspect, the methods further include providing an alkalinity source to increase the pH of the detergent use composition to an alkaline pH.

In an aspect, the dosing of the detergent composition for soft surface (i.e. linen) laundering applications will range between about 1-30 oz/cwt (fluid ounce per dry weight of 100 pounds linen), which will vary depending on the soil load and linen classification as one skilled in the art will ascertain. In an aspect, the detergent composition is applied to a laundering application at a dosing rate between about 1-30 oz/cwt, between about 1-25 oz/cwt, between about 1-20 oz/cwt, between about 1-15 oz/cwt, or between about 4-8 oz/cwt.

In an aspect, the detergent composition forms a use solution and is contacted with the soft surface in need of cleaning at an alkaline pH and an elevated temperature of at least about 100° F. or greater, at least about 140° F. or greater, and often between 130-180° F., or 130-160° F.

In some aspects, the compounds and compositions of the present invention can be used to lighten or remove stains from a substrate, e.g., hard surface, or fabric. The compounds of the present invention can be used to remove stains from any conventional textile, including but not limited to, cotton, poly-cotton blends, wool, and polyesters. The compounds of the present invention are also textile tolerant, i.e., they will not substantially degrade the textile to which they are applied. The compounds of the present invention can be used to remove a variety of stains from a variety of sources including, but not limited to, lipstick, pigment/sebum, pigment/lanolin, soot, olive oil, mineral oil, motor oil, blood, make-up, red wine, tea, ketchup, and combinations thereof.

Beneficially, the detergent compositions can be used alone to clean the articles, e.g., textiles, and/or can be used in conjunction with additional pre-treatment compositions and/or detergents. When used with a separate additive, such as a pre-treatment composition, a first pre-treatment step may be employed for any amount of time. For example, a pre-treatment composition may first contact the article before, or substantially simultaneously with the detergent composition according to the invention. Exemplary pretreatments include for example, pre-spot treatments, pretreatments, pre-soaks, and the like, which may be provided in the form of a liquid, foam, gel, stick, or the like that is applied directly to a stain on a textile and is permitted to remain in contact with the stain for a period of time sufficient to pre-treat the stain before the textile is washed and rinsed during a subsequent washing cycle, typically in an automated washing machine.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

In the various laundry detergent compositions and following examples, various component identifications are employed and having the following characteristics:

| Trade Name | Chemical Name | Avg. MW | Vendor |
|---|---|---|---|
| Acusol 445N | Polyacrylic acid, Na salt | 4,500 | Dow |
| Acusol 845 | Methacrylic acid/ethyl acrylate co/terpolymer | 30,000-50,000 | Dow |
| Belclene 200 | Polymaleic acid | | BWA Water Additives |
| Sokalan HP 165 | Polyvinylpyrrolidone (PVP) | 9,000 | BASF |
| Sokalan HP 53 | Polyvinylpyrrolidone (PVP) | 40,000 | BASF |
| Sokalan HP 70 | Polyamine, amphoteric | | BASF |

Example 1

To evaluate soil removal and prevention of soil-redeposition in industrial laundering, soil compositions were created to reflect the higher ratios of oils and metals found in industrial laundering. ASTM D4008 which provides methods for measuring anti-soil deposition properties of laundry detergents was modified to evaluate industrial laundering soils. In comparison to consumer laundry soil compositions (5 parts particulate: 1 part oil) employing a dose level of 0.6 g of soil/1 L of wash solution, a model soil composition for industrial laundry was employed (Hohenstein Institute in Germany) having a greater concentration of oil (at least 50%) and containing free metals (iron and copper in 10:1 ratio). A dose level of 2 g of soil/1 L of wash solution (significantly greater absolute amount of soil in comparison to consumer laundry, approximately 0.6 g/L) was employed for the industrial laundry soil compositions described in this Example, further illustrating the significant differences in soil compositions between consumer laundering and industrial laundering.

Oil suspension experiments were carried using various polymer raw materials. The experiments were carried out in the tergotometer at 140 F, with 1 L of soft water (0 grain) per pot and agitation at 100 rpm. The water was intentionally set to 0 grain to allow evaluation of polymer oil suspension capability independent of ability to control water hardness. For each test a commercially available, nonionic surfactant detergent was added at 0.5 g/L, together with 1.5 g/L of 50% NaOH. The various polymer raw materials tested each had different % solids, so the amounts added were varied to always deliver 10 mg of active polymer. After 1 min of agitation of all the detergent components, soil was added (1 g/L dirty motor oil and 0.2 g/L of vacuum cleaner dirt) and agitated for another 2 minutes. Without stopping the agitation, 4 unsoiled fabric swatches (two 100% polyester and two 65/35 polyester/cotton) were added and washed for 10 minutes.

At the end of the time, swatches were removed from the wash water, wrung out by hand and transferred to a pot containing 1 L of clean water (at the same hardness and temperature) and rinsed for 3 minutes. After completion of the rinse, swatches were removed, again wrung out by hand and dried in a dryer for 45 minutes.

After drying, the reflectance of the fabric swatches was measured on a spectrophotometer (ColorQuest XE, Hunter Associates Laboratory). The L* value is one of the color indices and generally is indicative of broad visible spectrum reflectance, where a value of 100% would be absolute white. Soil redeposition is manifested by a reduction of the L* value. The data below is presented as the change in the L* value (L*initial−L*final), with a higher value indicative of greater soil redeposition and a lower value indicative of less soil deposition, i.e. greater anti-redeposition capability of the tested polymer.

Table 1 shows the change in L* values of white fabric swatches, each washed with a different water conditioning polymer, wherein lower values are indicative of greater oil suspension, and therefore less deposition onto the fabric.

TABLE 1

| | Fabric type | |
|---|---|---|
| Polymer | Poly/cotton | 100% polyester |
| None | 2.93 | 26.04 |
| Acusol 445N | 2.81 | 23.91 |
| Acusol 845 | 1.64 | 3.36 |
| Belclene 200 | 2.49 | 23.86 |
| Sokalan HP 165 | 1.67 | 2.80 |
| Sokalan HP 53 | 1.97 | 5.86 |
| Sokalan HP 70 | 2.02 | 25.92 |

The results for the 100% polyester fabric show substantially less efficacy in anti-deposition, which is expected due to the hydrophobic characteristics of the fabric which attract oils. As a result, the absolute values for redeposition are much greater with 100% polyester than with a poly/cotton blend. Despite the differences in magnitude the trends are the same for both fabric types. As can be seen very clearly on polyester, three polymers demonstrate a marked improvement in oil suspension: Acusol 845, Sokalan HP 165 and Sokalan HP 53. The Sokalan HP 165 and HP 53 are both polyvinylpyrrolidone (PVP) polymers with molecular weights of 9,000 and 40,000, respectively. No other polymers provided meaningful improvement for oil suspension.

Example 2

A similar test method as the oil suspension method was used to evaluate metal handling capability of the various polymers. Modifications to the methodology of Example 1 include the use of a different nonionic, surfactant detergent, which has greater oil suspension capability. As the detergent employed has no water conditioning polymers, an additional builder that contains a conventional polyacrylate (Acusol 445N) was added (0.3 g/L). For this test the Acusol 445N was removed and each polymer was added at a dose of the polymer raw material to achieve the same amount of active polymer (0.032 g/L). In addition, the water hardness was increased to 5 grain to stress the polymer systems, and the dirty motor oil and vacuum cleaner dirt also included $FeCl_3$ added at 0.15 g/L to more closely mimic the model industrial laundry soil compositions.

Table 2 shows the change in L* values of white poly/cotton fabric swatches, each washed with a different water conditioning polymer, wherein lower values are indicative of greater oil suspension, and therefore less deposition onto the fabric.

TABLE 2

| Polymer | Change in L* |
|---|---|
| None | 5.51 |
| Acusol 445N | 2.93 |
| Acusol 845 | 2.81 |
| Belclene 200 | 4.71 |
| Sokalan HP 165 | 4.87 |

As shown in Table 2, despite providing excellent oil suspension in Example 1, the Sokalan HP 165 (PVP, MW 9000) exhibited minimal metal handling capability. The polymer currently used in the product, Acusol 445N (polyacrylate hompolymer, MW 4500) did show a meaningful improvement in metal handling capability, relative to the control (however, it was unable to provide the required soil anti-deposition in Example 1). The ionic structure of the Acusol 445N provides moderate metal chelation ability; however, it is expected this same structure prevents it from suspending oil.

Surprisingly, the Acusol 845 water conditioning polymer also provided very good metal handling with the lowest value of any of the polymers tested. Acusol 845 was the only polymer tested that was effective on both the oil suspension screen and the metal handling screen. The methacrylic acid/ethyl acrylate polymer is uniquely suited for industrial laundering through both its oil suspension capabilities and ability to handle metals in the presence of oil. This result is unexpected due to the distinct characteristics required for suspending oils (hydrophobic and therefore suspended in solution by more hydrophobic polymers) versus suspending metals ions in solution (requiring ionic, or hydrophilic, polymers). It is unexpected that a solution containing a polymer would be suitable for suspension of both types of soils found in industrial laundering.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. A method for removing soils from a soft surface and preventing redeposition comprising:

applying a detergent composition to a soft surface in need of cleaning within a washing machine, wherein the detergent composition comprises an acrylic acid polymer, surfactants, solvent, and a water conditioning polymer, wherein the acrylic acid polymer has at least 40 wt-% polymerized residues of acrylic monomers, and wherein the surfactants comprise greater than 50 wt-% of the detergent composition;

washing the soft surface, wherein the washing with said detergent composition suspends high oil and metal content soils present in industrial soils and prevents redeposition in industrial laundering applications; and rinsing and/or wiping the detergent composition from the soft surface.

2. The method of claim 1, wherein the soils on said soft surface contain mineral oils and metal ions.

3. The method of claim 1, wherein the detergent composition is dosed at a rate between about 1-30 oz/cwt (fluid ounce per 100 pounds dry weight of linen).

4. The method of claim 1, wherein the detergent composition forms a use solution and is contacted with said soft surface at a temperature of at least about 100° F. and no more than 180° F.

5. The method of claim 1, wherein the surfactants are nonionic and/or anionic surfactants, and wherein the acrylic acid polymer comprises polymerized residues of: (i) from 40 to 65 wt-% C1-C18 alkyl (meth)acrylates; (ii) from 25 to 55 wt-% C3-C6 carboxylic acid monomers, wherein the monomer is a mono-ethylenically unsaturated compound having one or two carboxylic acid groups; and (iii) from 0 to 20 wt-% monomers having the following structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$, wherein X is O or NH, R is H or $CH_3$, R' is $C_1$-$C_2$ alkyl, R" is $C_8$-$C_{25}$ alkyl, $C_8$-$C_{16}$ alkylphenyl or $C_{13}$-$C_{36}$ aralkylphenyl, n is an average number from 6-100 and m is an average number from 0-50, and wherein n≥m and m+n is 6-100.

6. The method of claim 1, wherein said surfactant(s) is a nonionic surfactant, said solvent is water and a lipophilic fluid, and said water conditioning agent is selected from the group consisting of an aminocarboxylate, polyacrylate, polycarboxylate, polycarboxylic acid and combinations thereof.

7. The method of claim 1, wherein said detergent comprises from about 1-10 wt-% of the acrylic acid polymer, from 51-90 wt-% of the surfactant, from 10-50 wt-% of the solvent, from 1-10 wt-% of the water conditioning polymer, and from 10-50 wt-% water.

8. The method of claim 1, further comprising drying the soft surface.

9. A method for removing soils from a soft surface and preventing redeposition comprising:

applying a detergent composition to a soft surface in need of cleaning and containing soils having mineral oil content and containing metal ions, wherein the detergent composition comprises an acrylic acid polymer, surfactants, solvent, and a water conditioning polymer, wherein the acrylic acid polymer has at least 40 wt-% polymerized residues of acrylic monomers, and wherein the surfactants comprise greater than 50 wt-% of the detergent composition;

washing the soft surface employing the detergent composition at a dosing rate between about 1-30 oz/cwt; and rinsing and/or wiping the detergent composition from the soft surface.

10. The method of claim 9, wherein the detergent composition forms a use solution and is contacted with said soft surface at a temperature of at least about 100° F. and no more than 180° F.

11. The method of claim 9, wherein said surfactant(s) is a nonionic surfactant, said solvent is water and a lipophilic fluid, and said water conditioning agent is selected from the group consisting of an aminocarboxylate, polyacrylate, polycarboxylate, polycarboxylic acid and combinations thereof.

12. The method of claim 9, wherein said detergent comprises from about 1-10 wt-% of the acrylic acid polymer, from 51-90 wt-% of the surfactant, from 10-50 wt-% of the solvent, from 1-10 wt-% of the water conditioning polymer, and from 10-50 wt-% water.

13. The method of claim 9, wherein the surfactants are nonionic, anionic and/or amphoteric surfactants, and wherein the acrylic acid polymer comprises polymerized residues of: (i) from 40 to 65 wt-% C1-C18 alkyl (meth)acrylates; (ii) from 25 to 55 wt-% C3-C6 carboxylic acid monomers, wherein the monomer is a mono-ethylenically unsaturated compound having one or two carboxylic acid groups; and (iii) from 0 to 20 wt-% monomers having the following structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$, wherein X is O or NH, R is H or $CH_3$, R' is $C_1$-$C_2$ alkyl, R" is $C_8$-$C_{25}$ alkyl, $C_8$-$C_{16}$ alkylphenyl or $C_{13}$-$C_{36}$ aralkylphenyl, n is an average number from 6-100 and m is an average number from 0-50, and wherein n≥m and m+n is 6-100.

14. An industrial laundering composition comprising:

an acrylic acid polymer comprising at least 40 wt-% polymerized residues of acrylic monomers;

greater than 50 wt-% of at least one nonionic and/or anionic surfactant;

a solvent;

at least one water conditioning polymer; and water, wherein the composition removes and prevents redeposition of high oil and metal content soils present in industrial laundering applications.

15. The composition of claim 14, wherein the acrylic acid polymer comprises polymerized residues of: (i) C1-C18 alkyl (meth)acrylates; (ii) C3-C6 carboxylic acid monomers, wherein the monomer is a mono-ethylenically unsaturated compound having one or two carboxylic acid groups; and (iii) monomers having the following structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$, wherein X is O or NH, R is H or $CH_3$, R' is $C_1$-$C_2$ alkyl, R" is $C_8$-$C_{25}$ alkyl, $C_8$-$C_{16}$ alkylphenyl or $C_{13}$-$C_{36}$ aralkylphenyl, n is an average number from 6-100 and m is an average number from 0-50, and wherein n≥m and m+n is 6-100.

16. The composition of claim 15, wherein the acrylic acid polymerized residues comprise from 40 to 65 wt-% C1-C18 alkyl (meth)acrylates, from 25 to 55 wt-% C3-C6 carboxylic acid monomers, and from 0 to 20 wt-% of monomers of the structures $H_2C{=}C(R)C(O)X(CH_2CH_2O)_n(CH(R')CH_2O)_mR''$ or $H_22C{=}C(R)C_6H_4C(CH_3)_2NHCO_2(CH_2CH_2O)_n(CH(R')CH_2O)_mR''$, and wherein the molecular weight of the acrylic acid polymer is from about 25,000-50,000.

17. The composition of claim 14, wherein said surfactants are alcohol ethoxylates and/or amine oxides, said solvent is water and/or a lipophilic fluid, and said water conditioning agent is selected from the group consisting of an aminocarboxylate, polyacrylate, polycarboxylate, polycarboxylic acid and combinations thereof.

18. The composition of claim 14, wherein said acrylic acid polymer and water conditioning polymer comprise from 1-10 wt-% of the detergent composition.

19. The composition of claim 14, wherein the pH of the composition in a use solution is an alkaline pH.

20. The composition of claim 14, comprising from 1-10 wt-% of the acrylic acid polymer, from 51-90 wt-% of the surfactant, from 10-50 wt-% of the solvent, from 1-10 wt-% of the water conditioning polymer, and from 10-50 wt-% water.

* * * * *